United States Patent [19]

Wood et al.

[11] 4,237,694

[45] Dec. 9, 1980

[54] COMBUSTION EQUIPMENT FOR GAS TURBINE ENGINES

[75] Inventors: Robert D. Wood, Welton; John Stockdale, Castle Donington, both of England

[73] Assignee: Rolls-Royce Limited, London, England

[21] Appl. No.: 17,957

[22] Filed: Mar. 6, 1979

[30] Foreign Application Priority Data

Mar. 28, 1978 [GB] United Kingdom ..... 11893/78

[51] Int. Cl.[3] ..... B05B 7/10

[52] U.S. Cl. ..... 60/738; 60/746

[58] Field of Search ..... 60/39.74 R, 39.74 B, 60/39.65, 39.12, 39.28 R, 738, 746; 261/76

[56] References Cited

U.S. PATENT DOCUMENTS

| | | | |
|---|---|---|---|
| 2,704,435 | 3/1955 | Allen | 60/39.65 X |
| 3,703,259 | 11/1972 | Sturgess et al. | 60/39.74 R X |

*Primary Examiner*—Jerry W. Myracle

*Attorney, Agent, or Firm*—Cushman, Darby & Cushman

[57] ABSTRACT

Combustion equipment designed to reduce smoke levels and the production of nitrogen oxides has a fuel burner mounted in the upstream wall of a combustion chamber, the fuel burner comprising a central duct partially surrounded by an annular duct, each of the ducts having an array of swirl vanes at their upstream ends and fuel inlet apertures downstream of the respective arrays of swirl vanes. The fuel supply to each of the ducts can be controlled to apportion the fuel flow between the two ducts in dependence of an engine parameter, such as speed, so that at low speeds a majority of the fuel is injected into the annular duct while at higher engine speeds, a majority of the fuel is injected into the central duct.

7 Claims, 2 Drawing Figures

COMBUSTION EQUIPMENT FOR GAS TURBINE ENGINES

This invention relates to combustion equipment for gas turbine engines.

BACKGROUND OF THE INVENTION

Combustion equipment design has been changed over recent years from the type using a fuel burner employing the fuel pressure jet principle to a fuel burner using the air-assisted principle. The primary motivation for this change has been the requirement to reduce the production of smoke as the pressure level within gas turbine high pressure spools has increased.

Usually air-assisted burners feature the injection of fuel tangentially into a circular or annular air passage in which there is a high velocity air flow. This creates a cylindrical liquid sheet adjacent to the wall of the air passage and the resulting fuel placement in the combustion chamber of a gas turbine engine is usually in the form of a hollow cone. The fuel/air mixture is thus consequently very rich about the fuel sheet, and large amounts of smoke can still be produced. At low engine power conditions, the spray can have a wide range of droplet sizes which are related to the thickness of the fuel sheet presented to the incident airstream.

It is one of the objects of the present invention therefore to provide combustion equipment for a gas turbine engine having a fuel burner which will provide a uniform spray of finely atomized fuel. A further object of the present invention is to provide combustion equipment which will produce reduced quantities of objectionable exhaust emissions, such as nitrogen oxides.

The formation of nitrogen oxides is dependent upon a number of inter-related factors, including the temperature of combustion (the higher the temperature, the more nitrogen oxides are produced), the concentrations of nitrogen and oxygen in the fuel/air mixture, and the residence time of the combustion products in the combustion chamber. In the case of the residence time, low nitrogen oxides emissions can be achieved by having a short residence time with efficient combustion or by having a longer residence time with less efficient combustion so that the temperature is maintained at a low value and is insufficient for significant quantities of nitrogen oxides to be formed.

Over the normal operating range of a gas turbine engine the conditions vary considerably in the combustion equipment because of variations in the air and fuel flow rates, and changing pressures and temperatures, and thus it is very difficult to reduce the formation of nitrogen oxides at all engine speeds.

In our prior British Pat. No. 1,427,146 a tubular primary intake containing a fuel injector is provided in the upstream wall of the flame tube. An end cap is located at the downstream end of the tubular intake, to define an annular radially directed gap between it and the end of the tubular intake. This gap directs the fuel/air mixture radially into the flame tube creating a first toroidal vortex substantially upstream of the gap, and a second toroidal vortex of opposite hand substantially downstream of the gap. This arrangement has the ability to achieve high combustion efficiencies at ground idling engine speeds without detriment to high speed performance.

BRIEF DESCRIPTION OF THE INVENTION

According to the present invention combustion equipment for a gas turbine engine comprises a fuel burner comprising a hollow duct intended to receive a flow of air, first swirl means located adjacent to the upstream end of the hollow duct, an annular outer duct at least partially surrounding the hollow duct, second swirl means located adjacent to the upstream end of the annular outer duct and means for injecting fuel into each duct downstream of the first and second swirl means.

The fuel may be injected into each duct normal to the axis of the ducts or at an acute angle to the axis of the ducts.

The fuel may be injected into each duct from the outer wall of the hollow duct, the fuel being injected radially inwardly into the hollow duct and radially outwardly into the annular duct.

Alternatively or additionally a fuel injector may be provided at the centre of the hollow duct. Alternatively additional means may be provided for injecting fuel into the outer duct from the outer wall thereof.

Preferably the means for injecting fuel into the ducts is controlled such that the fuel is injected into only one or both of the ducts at a time in dependence upon various engine parameters, such as engine speed and power requirements.

When the fuel is injected into both of the ducts the ratio of the volumes of fuel injected into each duct may be varied in dependence upon various engine parameters.

Thus at low engine power the majority or all of the fuel may be injected into the outer duct and at high engine power the majority or all of the fuel may be injected into the hollow duct.

Preferably the downstream end wall of the hollow duct is flared whereby a radial component of direction is imported to the fuel/air mixture issuing from the hollow duct. The downstream end wall of the annular outer duct may also be flared to import a radial component of direction to the fuel/air mixture issuing from the outer duct.

The invention also comprises a gas turbine engine having combustion equipment as set forth above.

BRIEF DESCRIPTION OF THE DRAWINGS

An embodiment of the invention will now be described by way of example only with reference to the accompanying drawings in which.

DETAILED DESCRIPTION OF THE INVENTION

Figure 1:
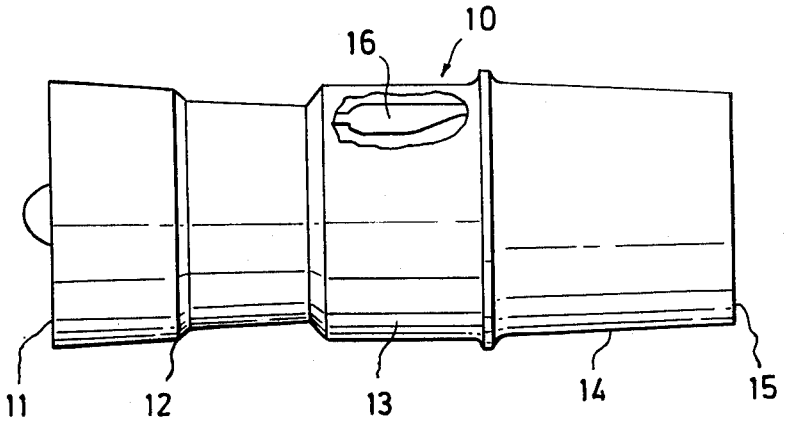
FIG. 1 is a partly sectioned side elevation of a gas turbine engine provided with combustion equipment according to the invention and FIG. 2 is an enlarged cross-sectional view of the combustion equipment.
Figure 2:
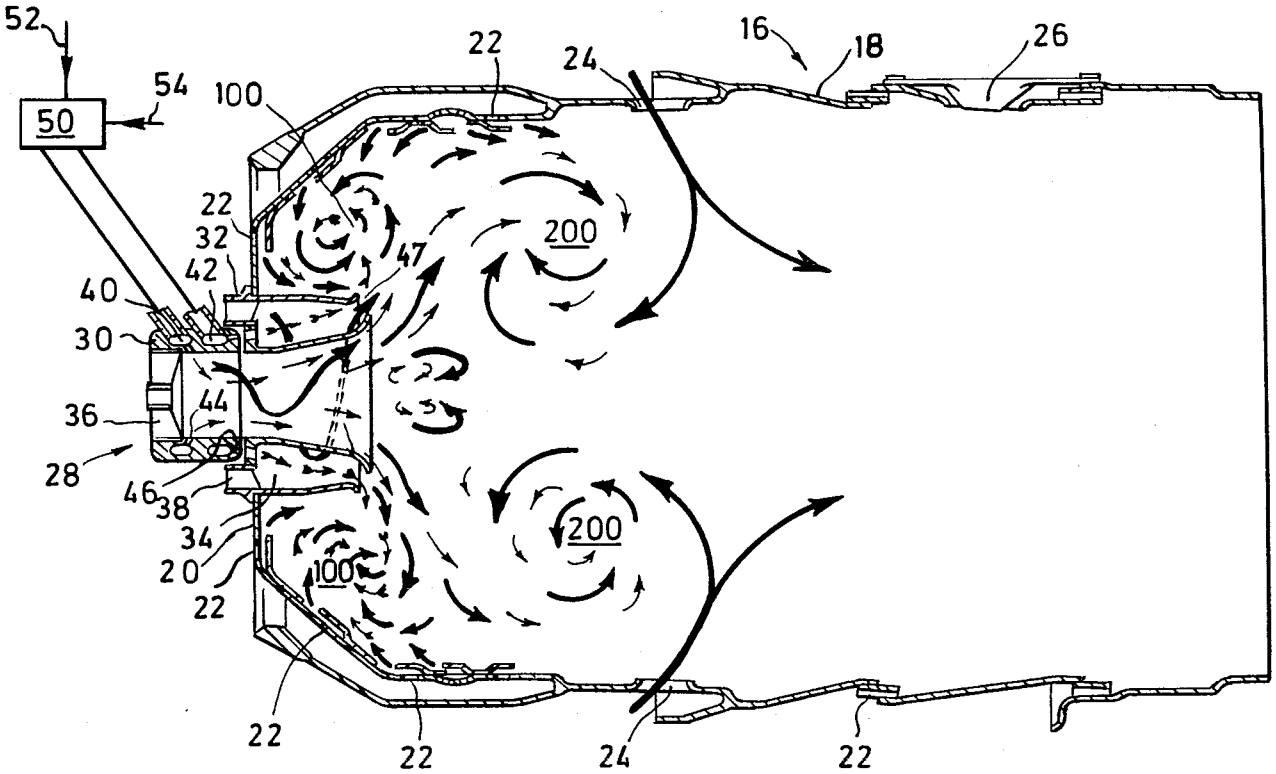

With reference to FIG. 1, a gas turbine engine generally indicated at 10 comprises, in axial flow series, an air intake 11, compressor means 12, combustion apparatus 13, turbine means 14 and an exhaust nozzle 15. Combustion apparatus 13 comprises a plurality of separate, substantially cylindrical combustion chambers, one of which can be seen at 16, circumferentially mounted around the axis of the engine 10 in the manner which is generally described as a "cannular" array.

Each combustion chamber consists of an annular wall 18 and an upstream end wall or base plate 20. Both the wall 18 and the base plate 20 are provided with small holes or orifices 22 to permit air to enter the combustion chamber for wall cooling purposes and larger holes 24 are provided in the wall 18 to permit combustion air to enter the chamber. The wall 18 is also provided with cooling air or dilution air holes 26, which air cools the combustion gases to a temperature acceptable to the turbine blades located downstream of the combustion chamber 16.

Mounted in the centre of the base plate 20 is a fuel burner 28 which consists basically of two coaxial tubes 30 and 32, the outer tube 32 surrounding the inner tube 30, and being slightly shorter than the inner tube 30 to define an annular passage 34 between the tubes. At the upstream end of the inner tube 30 is located a set of swirl vanes 36, and at the upstream end of the outer tube 32 is located a further set of swirl vanes 38, these vanes also serving to support the inner tube 30 in position. The two sets of swirl vanes 36, 38 can be arranged to generate swirling flows of either the same hand or of opposite hand.

The inner tube 30 is provided at its upstream end with two annular fuel manifolds 40 and 42 and holes 44 connect the manifold 40 with the interior of the tube 30, and holes 46 connect the manifold 42 with the passage 34. The holes 44 are arranged substantially perpendicularly to the axis of the burner 28.

The downstream ends of each of the inner tube 30 and the outer tube 32 are flared outwardly, the outer tube 32 terminating slightly upstream of the inner tube 30 to provide a substantially radially facing annular gap 47 at the end of the passage 34.

The supply of fuel to the two manifolds 40, 42 is controlled by a fuel scheduler 50 which receives fuel from a supply 52 and apportions the fuel to the manifold in dependence of an engine parameter 54, such as engine speed, compressor delivery pressure etc., as described in more detail below.

During operation of the burner, air enters the passage 34 and the interior of the tube 30 through the swirler vanes 38 and 36 respectively which impart a high degree of swirl to the air. The air passes out of the gap 47 and the end of the tube 30 in the direction of the arrows to create a first toroidal vortex 100 substantially upstream of the gap 46 and a second toroidal vortex 200 substantially downstream of the gap 46. These vortices are assisted by the incoming air through the holes 22 in the base plate 20 and the air entering the combustion chamber through the holes 24.

At low engine power the fuel scheduler 50 apportions the majority or all of the fuel to the manifold 42 from whence it is injected into the outer duct 34 and thence into the first toroidal vortex 100. By design of the combustion chamber, the equivalence ratios [Fuel/air ratio (actual)/Fuel/air ratio (stoichiometric)] of the first and second vortices can be optimized for maximum combustion efficiency at idle engine speeds. Since the fuel jets issuing from the holes 46 are angled to be substantially perpendicular to the swirled airflow, the very high relative velocity between the air and fuel achieves maximum atomisation.

As fuel flow/power is increased the fuel scheduler apportions a greater proportion of the fuel to the manifold 46 from whence it is injected into the inner tube 30 and thence directly into the second vortex 200. Thus at high power, because only a portion of the fuel is directed into the first vortex 100 its equivalence ratio is maintained below that which results in excessive smoke production.

The equivalence ratio of the second vortex 200 at high power is dictated to a large extent by airflow proportioning necessary to give optimum carbon monoxide consumption at idling speeds, but generally that fuel/air ratio in the second vortex 200 is similar to that of a conventional fuel burner. However, as the inner tube 30 fuel is intended to be pre-aerated, smoke production in the second vortex is minimal.

The differential fuelling of the two vortices ensures that the first vortex remains relatively rich in fuel so reducing the possibility of the production of nitrogen oxides.

At full power the two vortices can have equivalence ratios too rich for the production of nitrogen oxides followed by rapid dilution by air from the holes 26 to a low equivalence ratio of, for example, below 0.7.

The combustion equipment therefore offers a great control over the local equivalence ratios within the combustion chamber thus enabling nitrogen oxide and smoke production to be maintained at low levels at different engine powers.

The combustion equipment can be used not only for a "cannular" array, but also for tubo-annular combustion chamber or an annular combustion chamber.

We claim:

1. Combustion equipment for a gas turbine engine comprising a fuel burner including a hollow duct intended to receive a flow of air, first swirl means located adjacent to the upstream end of the hollow duct, an annular outer duct at least partially surrounding the hollow duct, second swirl means located adjacent to the upstream end of the annular outer duct and means for injecting fuel into each duct downstream of the first and second swirl means, said fuel injection means including a fuel supply means to each duct and fuel scheduling means arranged to receive a supply of fuel and to apportion said fuel supply to each said duct fuel supply means in dependence of a parameter of the gas turbine engine of which the combustion equipment forms a part.

2. Combustion equipment as claimed in claim 1 in which the duct fuel supply means comprises two fuel manifolds located at the upstream end of the hollow duct, each said fuel manifold having a plurality of fuel outlets into the corresponding duct.

3. Combustion equipment as claimed in claim 1 in which the downstream end wall of the hollow duct is flared outwardly to impart a radial component of direction to the fuel and air mixture issuing from the hollow duct.

4. Combustion equipment as claimed in claim 1 in which the downstream end wall of the annular outer duct is flared outwardly to impart a radial component of direction to the fuel and air mixture issuing from the outer annular duct.

5. Combustion equipment as claimed in claim 4 in which the downstream end wall of said annular duct terminates slightly upstream of the downstream end wall of said hollow duct, and the downstream end wall of said hollow duct is flared outwardly to impart a radial component of direction to the fuel and air mixture issuing from said hollow duct.

6. Combustion equipment for a gas turbine engine comprising a fuel burner including a hollow duct intended to receive a flow of air, first swirl means located adjacent to the upstream end of the hollow duct, an annular outer duct at least partially surrounding the hollow duct, second swirl means located adjacent to the upstream end of the annular outer duct and means for injecting fuel into each duct downstream of the first and second swirl means, said hollow duct having a downstream end wall which is flared outwardly to impart a radial component of direction to the fuel and air mixture issuing from the hollow duct.

7. Combustion equipment as claimed in claim 6 in which said annular outer duct has a downstream end wall which terminates slightly upstream of the downstream end wall of the hollow duct and is also flared outwardly to impart a radial component of direction to the fuel and air mixture issuing from the outer annular duct.

* * * * *